US005762542A

United States Patent [19]

Sandvold

[11] Patent Number: 5,762,542

[45] Date of Patent: Jun. 9, 1998

[54] EDGE GRINDER FOR MECHANICALLY ROUNDING OFF EDGES OF STRUCTURAL MEMBERS

[75] Inventor: Arne Sandvold, Hunndalen, Norway

[73] Assignee: Grobi A/S, Gjovik, Norway

[21] Appl. No.: 652,448

[22] PCT Filed: Dec. 13, 1994

[86] PCT No.: PCT/NO94/00204

§ 371 Date: Jun. 5, 1996

§ 102(e) Date: Jun. 5, 1996

[87] PCT Pub. No.: WO95/16546

PCT Pub. Date: Jun. 22, 1995

[30] Foreign Application Priority Data

Dec. 14, 1993 [NO] Norway ..... 934601

[51] Int. Cl.[6] ..... B24B 7/00

[52] U.S. Cl. ..... 451/188; 451/299; 451/301; 451/303

[58] Field of Search ..... 451/188, 299, 451/301, 302, 303, 190, 194, 182, 241, 282

[56] References Cited

U.S. PATENT DOCUMENTS

| | | | |
|---|---|---|---|
| 3,715,839 | 2/1973 | Hesemann . | |
| 3,845,588 | 11/1974 | Huffman, Jr. | 451/301 |
| 4,119,015 | 10/1978 | Tuda et al. | 451/188 |
| 4,471,822 | 9/1984 | Griganavicius | 451/201 |
| 4,628,640 | 12/1986 | Johannsen | 451/303 |
| 5,163,249 | 11/1992 | Kantanen | 451/299 |
| 5,295,329 | 3/1994 | Rothlisberger | 451/303 |
| 5,492,498 | 2/1996 | Casillas et al. | 451/539 |

FOREIGN PATENT DOCUMENTS

| | | |
|---|---|---|
| 0 197 233 | 10/1986 | European Pat. Off. . |
| 0 383 746 | 8/1990 | European Pat. Off. . |
| 1 045 077 | 11/1958 | Germany . |
| 3 916 775 | 11/1990 | Germany . |
| 90 02175 | 5/1992 | Netherlands . |

*Primary Examiner*—Robert A. Rose
*Assistant Examiner*—George Nguyen
*Attorney, Agent, or Firm*—Young & Thompson

[57] ABSTRACT

An edge grinding device for rounding off edges of members which are passed through the grinding device. The device includes a main frame for supporting the structural member, and a grinding aggregate which is pivotably mounted on the frame about an axis running substantially parallel to the directional motion of the member, the grinding aggregate having a grinding element which has a convex grinding surface, wherein the grinding aggregate pivots the convex grinding surface about the edge which is to be round while the member is moving through the device.

14 Claims, 4 Drawing Sheets

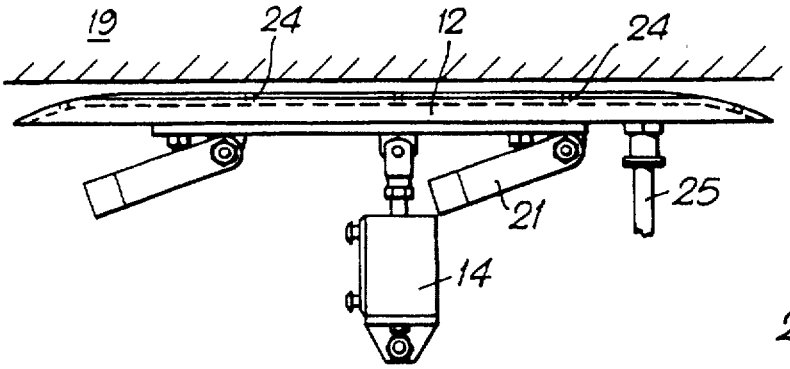
Fig.4.
Fig.5.
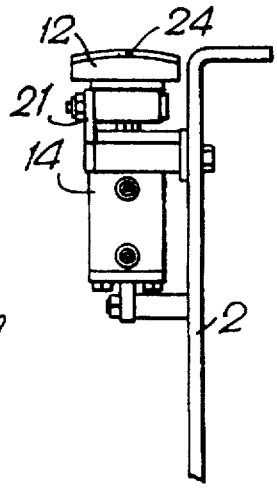
Fig.7.
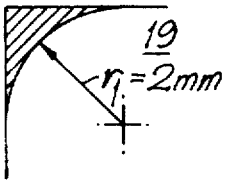
Fig.6A.
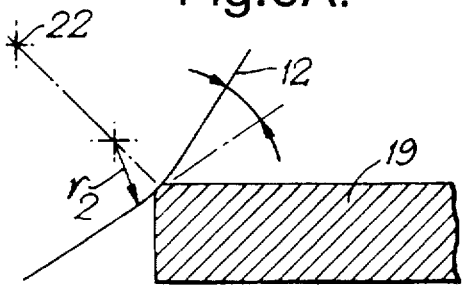
Fig.6B.
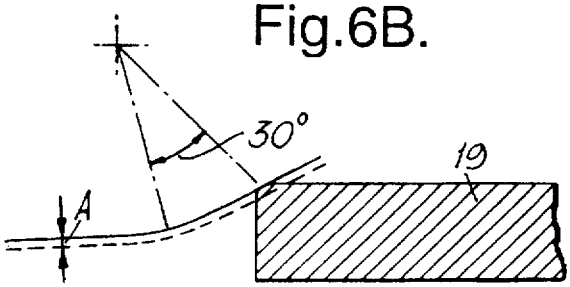
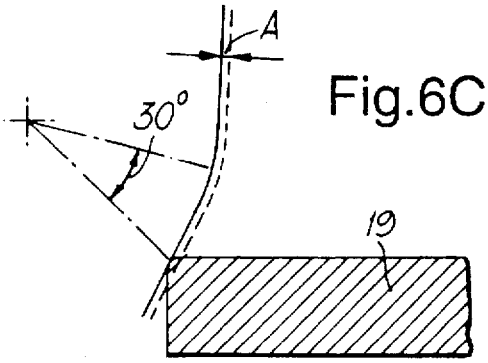
Fig.6C.
Fig.6D.
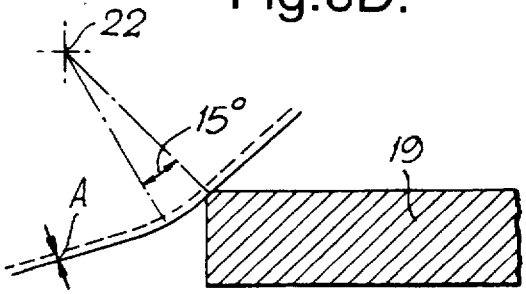

EDGE GRINDER FOR MECHANICALLY ROUNDING OFF EDGES OF STRUCTURAL MEMBERS

The present invention relates to an edge grinding device for mechanically rounding edges of structural members which are passed through said edge grinding device, comprising a main frame having, in relation to the direction of travel, transversally extending support rollers upon which the structural member is supported and is driven forward.

An edge grinder of this type is known from NL-9002175.

The purpose of the invention has been to provide a machine for rounding off edges of structural members, such as rolled steel sections and sheets. Today it is a requirement in offshore structures that all edges of steel sections have a radius of curvature of at least 2 mm and sometimes more. This is due to maintenance and corrosion protection. So far, this rounding-off procedure has usually been carried out manually by means of an angular grinder or facing machine.

It is documented by tests that the principle on which the present edge grinding device is based provides a very good quality in the rounding off of steel section edges and far exceeds the quality achieved today by angular grinders.

In accordance with the present invention there has been provided an edge grinding device of the introductory part of this description, characterized by having at least one grinding aggregate with a movable grinding element, said grinding aggregate being pivotally mounted on a frame about an axis which runs substantially parallel to the advancement axis of the structural member, said pivotal axis being located outside the structural member, that the cross-sectional profile of the grinding element has a predetermined geometric form adapted to the location of the pivotal axis and the radius of curvature of the rounding of the edges, and that the grinding element is pressed yieldingly or resiliently against the edge.

Such a design entails, inter alia, that the grinding element will be worn down evenly throughout its entire crosswise area, thus providing a long useful lifetime to the individual grinding element before replacement.

It is contemplated that the grinding aggregate can be in the form of a motor operated grinding wheel having a predetermined geometrically configured surface, but it has proved to be advantageous that the grinding aggregate is in the form of a belt grinder or belt sander in which a grinding belt or sand belt runs between and around two rollers.

Even though it is actually unnecessary to have more than one grinding aggregate for each edge grinding device, such an aggregate may advantageously be mounted on each side of the structural member for simultaneous grinding of two edges.

Advantageously, two more grinding aggregates may be mounted on each side of the structural member downstream of the first grinding aggregate or the first pair of grinding aggregates, for simultaneous grinding of two additional edges in one run, such as grinding edges of steel beams having an I or H section.

The edge grinding device may advantageously comprise vertically and horizontally mounted guiding rollers for controlled guidance of the structural member through the edge grinding device. Advantageously, the grinding aggregate may comprise air nozzle means for air supply and for the formation of an air cushion between the grinding shoe of the grinding aggregate and the grinding belt, so as to reduce the friction and/or cool the grinding belt.

It is expedient that each grinding aggregate has an independent power or motor operation. Further, each grinding shoe can be pressed against the edge or be raised or lowered by an apparatus, such as a fluid powered cylinder, for the purpose of regulating the grinding pressure, and thus provide a yielding or a certain resiliency in relation to the edges of the structural member so as to absorb any roughness therein, simultaneously with the grinding element being fed toward the edge as the metal is ground away.

Each grinding aggregate is advantageously pivotable by means of a link mechanism and a fluid power cylinder about said pivotal axis, thus making a kind of pendulum movement.

Other and additional objects, features and advantages will be apparent from the following description of one, at present preferred embodiment of the invention, which is presented for the purpose of description, without thereby limiting the invention, in connection with the enclosed drawings wherein:

FIG. 4 shows a schematic side view of the grinding shoe in the grinding aggregate;

FIG. 5 shows an end view of the grinding shoe according to FIG. 4;

FIGS. 6A–6D show schematically the geometric design of the grinding area and the pendulum movement that it performes; and FIG. 7 shows the material that is ground away, and the center of r discloses the point where it would normally be considered natural to place the pivotal axis of the grinding aggregate.

Figure 1:
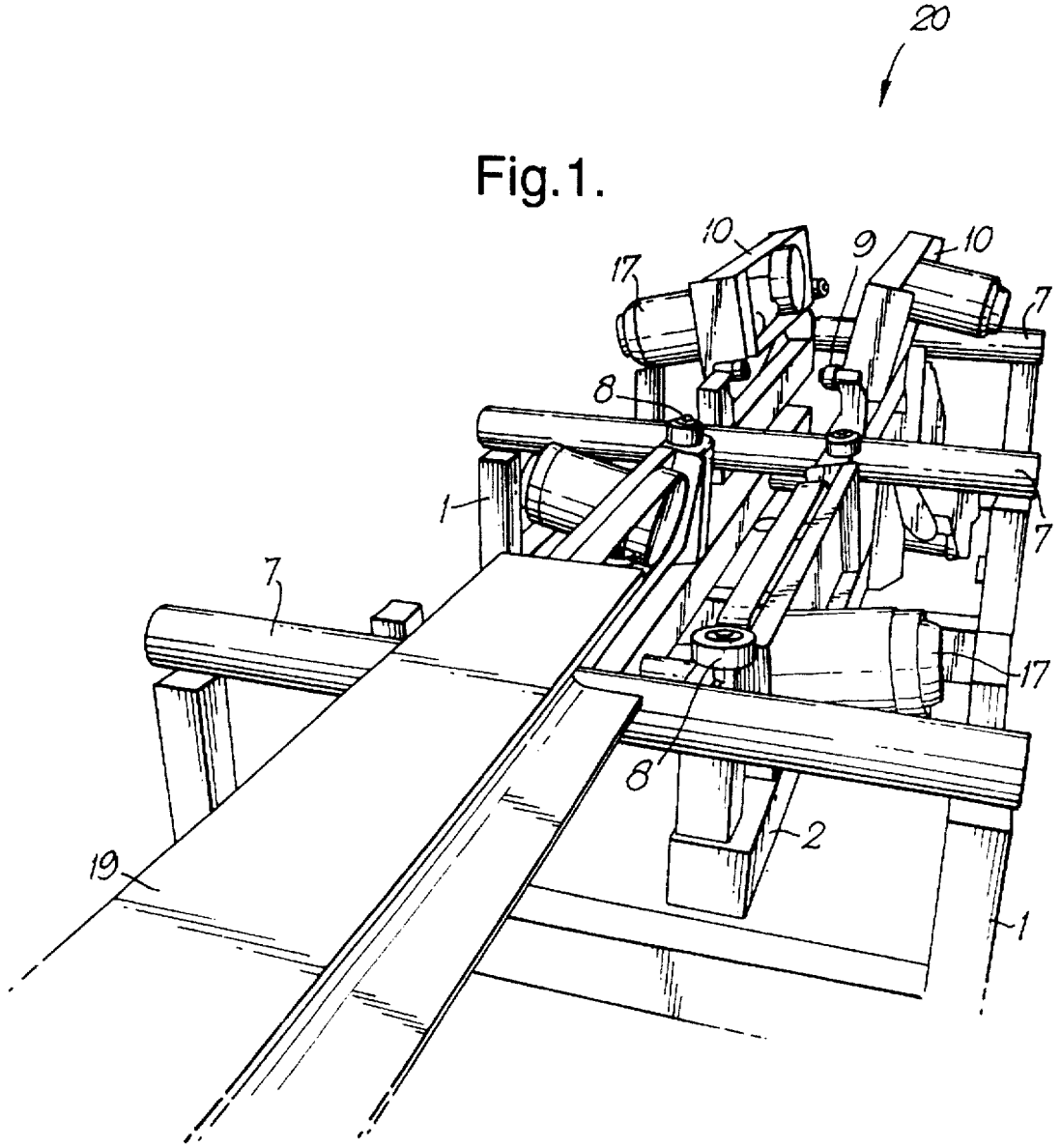
FIG. 1 shows in perspective view an embodiment of the edge grinding device according to the present invention having four independent grinding aggregates.

FIG. 1 is a depiction in perspective of the edge grinding device 20 according to the invention. The edge grinding device 20 is structured on a main frame 1, resting on the ground. On said main frame 1 there are mounted three support rollers 7 which shall support a structural member 19 which is advanced through the edge grinding device 20. For lateral control of the structural member 19 through the edge grinder 20 guiding rollers 8 are mounted on each side of the travelling path of the structural member 19. In addition, guiding rollers 9 are provided having horizontal rotational axes. The guiding rollers 8 and 9 allow for controlled movement of the structural member 19 through the edge grinder 20. Four grinding aggregates 10 are pivotally attached to the main frame 1. Each grinding aggregate 10 is operated by its respective motor 17 which preferably is operated in complete independence of the others, and is able run in both directions.

Figure 2A:
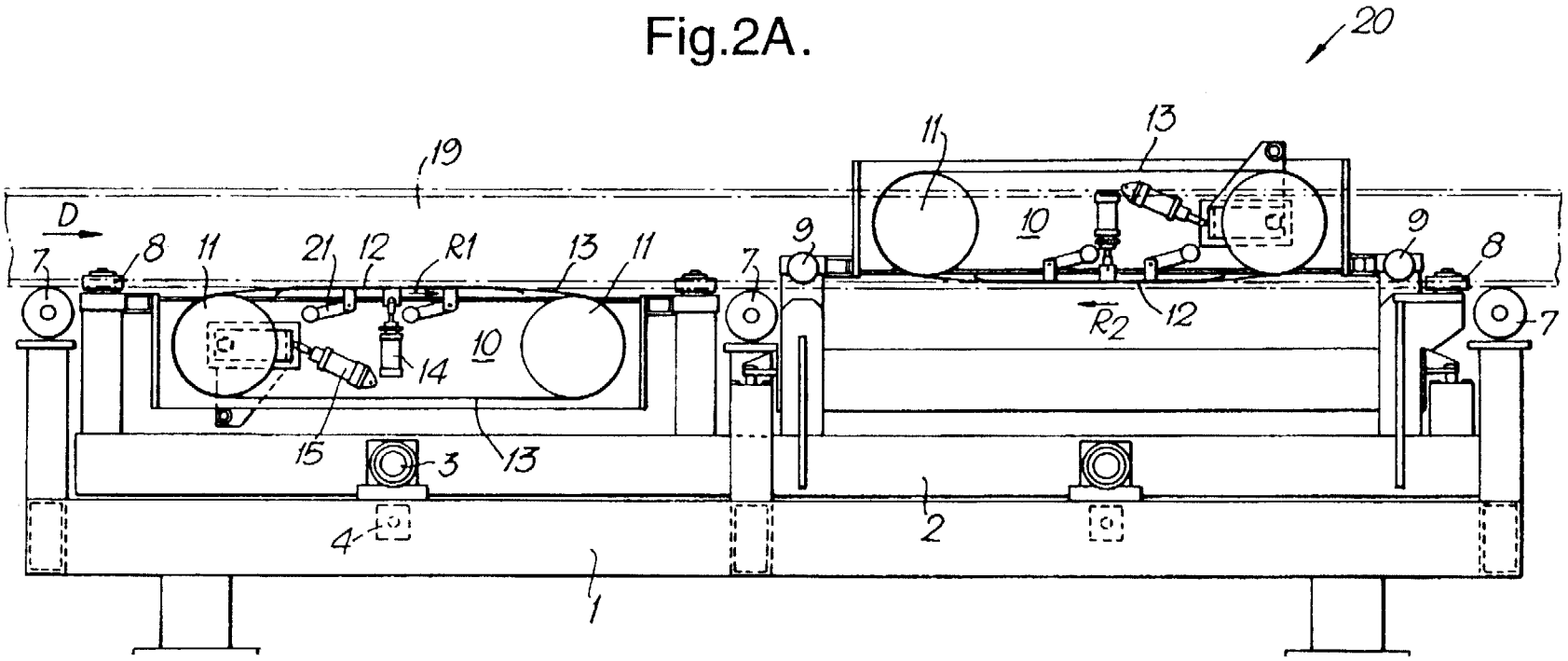
FIG. 2A shows schematically a side view of the edge grinding device according to FIG. 1 having a forward grinding section 1 and a rear grinding section 2.

FIG. 2A shows a side view of the edge grinder 20. The edge grinder 20, in this embodiment, has a front grinding section 1 and a back grinding section 2. Each grinding section has two grinding aggregates 10, one on each side of the structural member 19. With a total of four grinding aggregates 10 four edges may be rounded off simultaneously. Each grinding aggregate 10 comprises two driving wheels 11 around which a grinding belt 13 runs. The sand belt or grinding belt 13 also runs across a grinding shoe 12. Said grinding shoe 12 may be raised or lowered to alter the bias of the grinding belt 13 against the edge of the structural member 19 by means of a grinding pressure cylinder 14. The grinding shoe 12 is rotatably mounted by means of extensions 21. One driving wheel 11 may be monitored by a fluid powered cylinder 15 for tensioning the grinding belt 13. The arrow D shows the normal feeding direction of the structural member 19. The arrows R1 and R2 show, respectively, the direction of the grinding belt 13 in grinding sections 1 and 2 during operation of the aggregate 10. As previously mentioned, it is understood that the belt 13 can be run in both directions. Moreover, additional edges of the structural member 19 can be ground on return through the machine (in the opposite direction of the arrow D).

It is to be understood that in one embodiment the edge grinder may consist of only one grinding section 1, alternatively of only the other grinding section 2. As yet another alternative the edge grinder may consist of only one grinding aggregate, optionally three. If all eight edges of an I-beam are to be ground in one run, eight grinding aggregates would be needed, preferably mounted in four grinding sections.

Each grinding aggregate 10 is secured to a carrier section 2 which is again secured to the main frame 1.

Figure 2B:
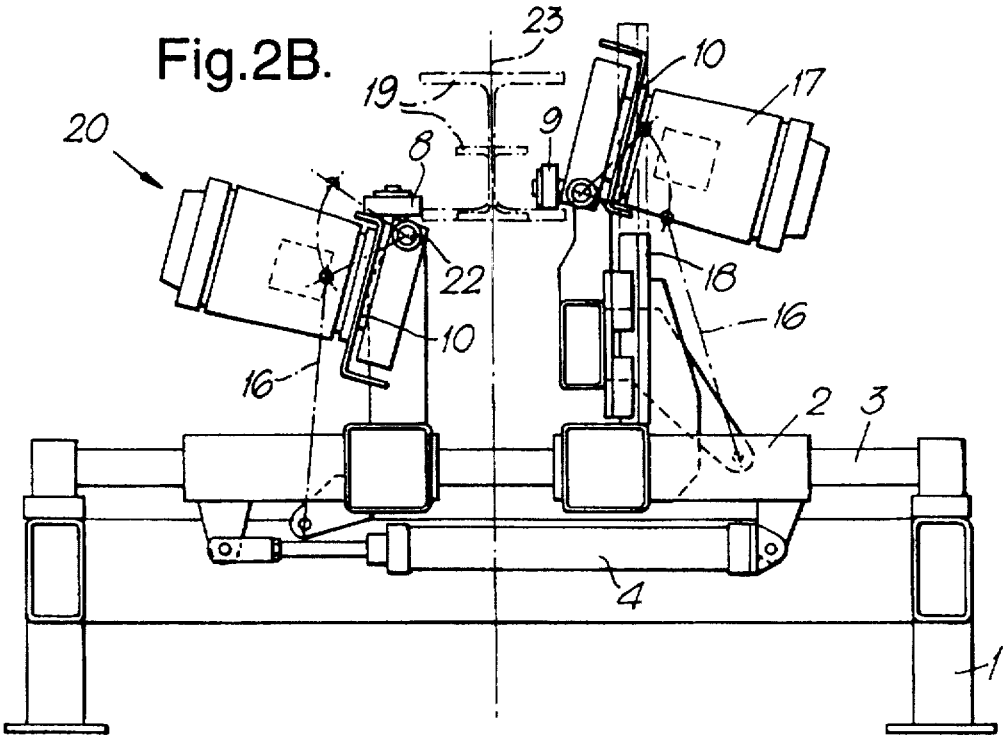
FIG. 2B shows schematically an end view of the edge grinding device according to FIG. 2A having the grinding section 1 on the left side and the grinding section 2 on the right side.

FIG. 2B shows an end view of the edge grinder 20 having the grinding section 1 on the left side and the grinding section 2 on the right side of a dotted centre line 23. At grinding section 1 the lower edge of the lower flange of the structural member 19 is ground. In section 2 the upper edge of the lower flange of the structural member. 19 is rounded off. The grinding aggregate 10 can be pivoted about a pivotal axis 22 running parallel to the feeding direction of the structural member 19 and thus in the longitudinal direction. The pivotal movement, or the pendulum movement, of the grinding aggregatee 10 is effected by a pendulum cylinder 16 illustrated by a dotted line. Furthermore, the grinding aggregates 10 can be moved away from each other or toward each other by means of a transverse cylinder 4 which is attached to its respective part of the carrier section 2. The carrier section 2 moves on the transverse guides 3.

Figure 3A:
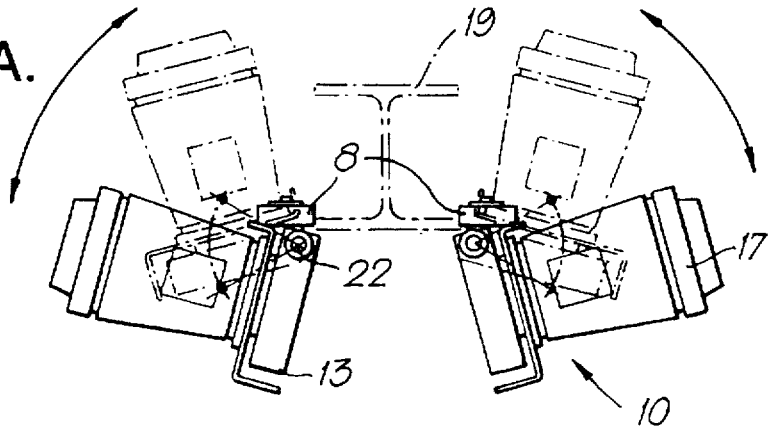
FIG. 3A shows schematically the pendulum movement in the grinding section 1.
Figure 3B:
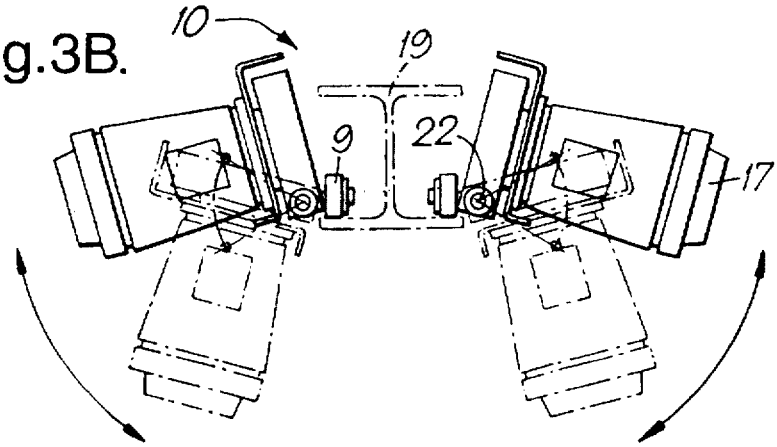
FIG. 3B shows schematically the pendulum movement in grinding section 2.

The pendulum movement of the grinding aggregates 10 is further shown in FIG. 3A for grinding section 1, and FIG. 3B for grinding section 2. Note that the pivotal axis 22 of the grinding aggregate 10 lies outside the structural member 19, and by means of this position and the geometric design of the bearing surface of the shoe 12, shown in FIG. 6, it is possible to form finely rounded edges on the structural member 19.

FIG. 4 shows in further detail the grinding shoe 12. This comprises one or more air nozzle means 24 for supply of pressurized air via the supply tube 25. By means of this air an air cushion is formed between the grinding shoe 12 and the grinding belt 13. Simultaneously, the air will cool the grinding belt 13.

FIG. 5 shows an end view of the grinding shoe 12 according to FIG. 4. The whole unit is secured to the carrier section 2. The grinding pressure cylinder 14 can increase/decrease the bias of the grinding belt 13 against the structural member 19.

FIGS. 6A–6D show schematically a cross-sectional view of the very surface of the grinding shoe 12 along which the grinding belt 13 runs. The drawings show how the grinding shoe 12 makes a pendulum movement from one exterior side to the other, for example making an arc of 60° in total. Simultaneously, the pendulum suspension means, i.e., the extensions 21 and cylinder 14 in FIGS. 4 and 5, ensures a resilience of the grinding shoe 12. The resilient movement is suggested by an A in FIGS. 6B, 6C and 6D. The cylinder 15 ensures correct tensioning of the grinding belt 13. The pressure of the cylinders 14 and 15 must be coordinated. When the cylinder 14 urges the shoe 12 upward, the cylinder 15 must give way correspondingly in order to retain the tension of the belt.

It is to be understood that the embodiment of the grinding shoe 12, i.e., its cross-sectional profile, is of crucial importance in obtaining a good grinding result. Tests have shown that it is important that the grinding shoe 12 urges the grinding belt 13 heavily against the edge to be ground and that the belt 13 be fed to the edge as the material is ground away. This is achieved by the fact that the grinding shoe 12 is resilient and also capable of following possibly uneven/curved surfaces of the structural member 19. Moreover, as noted, cooling should preferably be provided, otherwise the grinding belt 13 will become so hot that it breaks at the Joint. FIGS. 6A–6D may also, in principle, represent the surface configuration of a rotatable grinding wheel as an alternative to a belt grinder.

In order to obtain a satisfactory grinding result a further aspect is important, viz., the geometry of the movement of the grinding shoe 12. This comes in addition to the design of the form of the grinding shoe, which must be somewhat curved. When a rounding-off radius of, for example, 2 mm is to be achieved, it would seem appropriate that the rotational center of the grinding shoe 12 be positioned at the center of $r_1$ as shown in FIG. 7. However, in terms of structure the disadvantage is that the point of rotation then must be positioned inside the material to be ground. Tests that have been made show that this is possible in simply practical terms, but in terms of operation and maintenance it will be a cumbersome method. In addition, wear and tear of the grinding element will be concentrated, which must be exchanged more frequently. For a belt grinder this disadvantage could be remedied by tilting the grinding aggregate and thereby the grinding belt somewhat in relation to the edge of the structural member 19. FIGS. 6A–6D thus show how this problem has been solved. The grinding shoe 12 moves around the rotational center 22, and with respect to the shape of the grinding shoe, there are two parameters, viz., the curves radius $r_2$ and the angle $\alpha$. The angle $\alpha$ and the curves radius $r_2$ form a relationship of dependency upon the distance a between the edge of the structural member 19 and the rotational center 22. It is suggested that the angle $\alpha$ should be in the range of 10° and 20°, and in a prototype an angle $\alpha$=14° has been found advantageous. The corresponding radius of survature is then $r_2$=27 mm, and the deflection of the angle in the pendulum movement is 30° on each side, i.e., 60° in total. In addition the "resilience" A is an important parameter which provides additional feeding as the material of the edge (see FIG. 7) is ground away.

I claim:

1. An edge grinding device for mechanically rounding off an edge of a structural member (19) which is passed through said edge grinding device (20), the device comprising:

a main frame (1) having, in relation to the direction of travel D, transversally extending support rollers (7) upon which the structural member (19) is supported and is driven forward, at least one grinding aggregate (10) having a movable grinding element (13), said grinding aggregate (10) being pivotally mounted on a pivot on said frame, said pivot having an axis running substantially parallel to the direction D and located outside the structural member (19), a fluid powered cylinder for pivoting said grinding aggregate, wherein a cross-sectional profile of the grinding element (13) is convex relative to the edge, and wherein the grinding element is pressed resiliently against the edge when the structural member (19) is passed through the device.

2. An edge grinding device according to claim 1, wherein the grinding aggregate (10) comprises a belt grinder, and the grinding element is a belt having its cross-sectional profile defined by a convex grinding shoe (12) across which the grinding belt runs.

3. An edge grinding device according to claim 1, wherein the grinding aggregate comprises a rotating grinding wheel having said convex cross-sectional profile.

4. An edge grinding device according to claim 1, comprising at least two of said grinding aggregate (10) for simultaneous grinding of two of the edges.

5. An edge grinding device according to claim 4, comprising at least four of said grinding aggregate for simultaneous grinding of four of the edges.

6. An edge grinding device according to claim 2, wherein said grinding aggregate (10) comprises air nozzle means (24) for forming an air cushion between the grinding shoe (12) and the grinding belt (13).

7. An edge grinding device according to claim 4, wherein each said grinding aggregate (10) has its own operating motor.

8. An edge grinding device according to claim 2, further comprising a further fluid powered cylinder (14) connected to said grinding shoe for regulating the grinding pressure.

9. A grinding device for grinding an edge of a member, the device comprising:

a frame for slidably supporting the member to be ground as the member is moved through the device;

a grinding aggregate with a grinding element for grinding an edge of the member, said grinding element having a grinding surface which is convex relative to the edge of the member;

a pivot attached to said frame and said grinding aggregate for pivoting said grinding surface through an arc so that the edge of the member is rounded by the pivoting grinding surface when the member is moved through the device.

10. The device of claim 9, wherein said grinding element is a belt and said grinding aggregate further comprises a shoe with a convex surface across which said grinding element runs, thereby forming the convex shape of said grinding surface.

11. The device of claim 10, wherein said grinding aggregate further comprises a grinding pressure cylinder attached to said shoe for pushing said grinding surface against the edge to be ground.

12. The device of claim 9, wherein an axis of said pivot is a first distance from the edge to be ground, and wherein the convex shape of said grinding surface includes a center rounded portion with a radius smaller than said first distance and two tangential edge portions extending from opposing sides of said center portion.

13. The device of claim 12, wherein an angle between one of said tangential edge portions and an extension of the other of said tangential edge portions is from 10° to 20°.

14. The device of claim 9, wherein an axis of said pivot is a substantially parallel to a direction of movement of the member.

* * * * *